US009478153B1

(12) United States Patent
Seder

(10) Patent No.: US 9,478,153 B1
(45) Date of Patent: Oct. 25, 2016

(54) ILLUMINATED CYLINDRICAL ANIMATION DEVICE

(71) Applicant: Rufus Butler Seder, Arlington, MA (US)

(72) Inventor: Rufus Butler Seder, Arlington, MA (US)

( * ) Notice: Subject to any disclaimer, the term of this patent is extended or adjusted under 35 U.S.C. 154(b) by 132 days.

(21) Appl. No.: 14/191,795

(22) Filed: Feb. 27, 2014

Related U.S. Application Data

(60) Provisional application No. 61/770,141, filed on Feb. 27, 2013.

(51) Int. Cl.
*G09F 11/00* (2006.01)
*G09F 11/04* (2006.01)
*G09F 11/23* (2006.01)

(52) U.S. Cl.
CPC ..... *G09F 11/04* (2013.01); *G09F 11/23* (2013.01)

(58) Field of Classification Search
CPC ..... G09F 11/025; G09F 11/23; G09F 11/02; G09F 15/0081; G09F 13/36; G09F 11/00; G09F 11/12; B44F 1/10; A47F 5/025
USPC ..... 40/430, 431, 434, 436, 473, 484, 493, 40/503
See application file for complete search history.

(56) References Cited

U.S. PATENT DOCUMENTS 294,430 A 7/1860 Ames
697,907 A 4/1902 Wilder
725,567 A 4/1903 Ives
762,519 A 6/1904 Farrand
829,492 A 8/1906 Spiegel
829,902 A 8/1906 Urry
RE13,109 E 5/1910 Spiegel
1,150,374 A 8/1915 Kanolt
1,259,297 A 3/1918 Russell
1,260,682 A 3/1918 Kanolt
1,285,753 A 11/1918 Lowenstein
1,474,572 A 11/1923 Whitstock
1,475,430 A 11/1923 Curwen
1,804,260 A 5/1931 Kerr
1,838,173 A 12/1931 Chretien
1,918,705 A 7/1933 Ives
2,045,129 A 6/1936 Farrand
2,058,581 A 10/1936 Fegan
2,085,803 A 7/1937 Harrison
2,151,301 A 3/1939 Percy et al.
2,177,417 A 10/1939 Eggert
2,182,325 A 12/1939 Tucker
2,246,001 A 6/1941 Powers
2,350,733 A 6/1944 Drotning
(Continued)

*Primary Examiner* — Cassandra Davis
(74) *Attorney, Agent, or Firm* — Thomas P. O'Connell; O'Connell Law Firm

(57) ABSTRACT

An animation device for producing animation of interlaced coded images with inner and outer sleeves retained for concentric rotation, a plurality of coded images retained by one sleeve, and a plurality of spaced shutter elements and interposed viewing elements retained by the other sleeve. The inner and outer sleeves are retained by a base structure with one sleeve rotatable in relation to the base structure and the other sleeve fixed against rotation relative to the base structure. A light source can be disposed within the inner sleeve, and a motor can rotate a platform that retains the rotatable sleeve. The fixed sleeve can be encased and fixed in position by a frusto-conical sleeve forming a fixation member. The inner and outer sleeves can be precisely formed by alignment of registration apertures on a peg board with registration pegs.

11 Claims, 13 Drawing Sheets

(56) References Cited

U.S. PATENT DOCUMENTS

| | | | | |
|---|---|---|---|---|
| 2,367,967 | A | | 1/1945 | Schwartz |
| 2,374,371 | A | | 4/1945 | Morch |
| 2,398,257 | A | | 4/1946 | Schwartz |
| 2,482,947 | A | | 9/1949 | Swarbrick |
| 2,528,765 | A | | 11/1950 | Lindberg, Jr. |
| 2,551,188 | A | | 5/1951 | Wagner |
| 2,645,047 | A | | 7/1953 | O'Gorman |
| 2,876,570 | A | | 3/1959 | Swarbrick |
| 2,915,843 | A | | 12/1959 | Pabst et al. |
| 2,917,854 | A | | 12/1959 | Swarbrick |
| 2,918,743 | A | | 12/1959 | Swarbrick |
| 2,959,872 | A | | 11/1960 | Rodgers |
| 3,000,125 | A | | 9/1961 | Elvestrom |
| 3,082,560 | A | | 3/1963 | Elvestrom |
| 3,145,250 | A | | 8/1964 | Vargady |
| 3,235,987 | A | | 2/1966 | Yates |
| 3,268,238 | A | | 8/1966 | Finkel |
| 3,314,179 | A | | 4/1967 | Leach |
| 3,365,350 | A | | 1/1968 | Cahn |
| 3,370,371 | A | | 2/1968 | Swarbrick |
| 3,484,969 | A | | 12/1969 | Newland |
| 3,589,045 | A | | 6/1971 | Rakowsky |
| 3,643,361 | A | | 2/1972 | Eaves |
| 3,683,525 | A | | 8/1972 | Fukui |
| 3,745,966 | A | | 7/1973 | Seager |
| 3,826,028 | A | | 7/1974 | Shaw |
| 3,862,504 | A | | 1/1975 | Ringelheim et al. |
| 3,961,434 | A | | 6/1976 | Sampon |
| 4,118,879 | A | | 10/1978 | Simon |
| 4,263,737 | A | | 4/1981 | Simon |
| 4,622,769 | A | | 11/1986 | Friedman |
| 4,789,573 | A | | 12/1988 | Jenkinson |
| 4,885,193 | A | | 12/1989 | Head |
| 5,152,089 | A | | 10/1992 | Bellico |
| 5,197,886 | A | | 3/1993 | Sekiguchi |
| 5,525,383 | A | * | 6/1996 | Witkowski ..... A47G 19/2227 206/217 |
| 5,588,526 | A | | 12/1996 | Fantone et al. |
| 5,695,346 | A | | 12/1997 | Sekiguchi et al. |
| 5,695,415 | A | | 12/1997 | Docherty et al. |
| 5,782,026 | A | | 7/1998 | Capie |
| 5,901,484 | A | | 5/1999 | Seder |
| 6,286,873 | B1 | | 9/2001 | Seder |
| 6,385,875 | B1 | | 5/2002 | Santorsola |
| 6,781,761 | B2 | | 8/2004 | Raymond |
| 6,886,280 | B2 | | 5/2005 | Spodek et al. |
| 7,000,343 | B1 | | 2/2006 | Teichman |
| 7,151,541 | B2 | | 12/2006 | Seder |
| 7,331,132 | B1 | | 2/2008 | Seder |
| 2002/0105808 | A1 | * | 8/2002 | Ting Yup ..... 362/281 |
| 2003/0070333 | A1 | | 4/2003 | Usher et al. |
| 2004/0229193 | A1 | | 11/2004 | Wittmeyer et al. |

* cited by examiner

ILLUMINATED CYLINDRICAL ANIMATION DEVICE

FIELD OF THE INVENTION

The present invention relates generally to display devices. More particularly, disclosed herein is an illuminated cylindrical animation device for displaying a plurality of coded images in a crisp and clear manner by a relative rotation of a coded image sleeve and a concentrically disposed shutter element sleeve.

BACKGROUND OF THE INVENTION

Devices permitting the sequential display of a plurality of coded images by movement of an image member relative to a shutter member have been known for many years. In a typical arrangement, the image member retains a plurality of interposed coded images while the shutter member retains a plurality of shutter elements that are separated by a plurality of viewing elements. The shutter elements perform dual functions. They selectively block from view all but one of the interposed coded images, and they bridge the gaps between the coded strips that cooperate with the shutter elements to form what can be termed an active image. With this, the plurality of shutter elements decode the active image so that it appears to be a complete, coherent image.

When the image member and the shutter member undergo relative movement by a predetermined amount, the strips of the previously active image become concealed and the next succeeding coded image assumes the fleeting position as the active image. This transition from image to image will continue through a cycle of the coded images that are disposed on the image member. Once the cycle is complete, the first coded image will again appear thereby starting a new, identical cycle. The coded images can be sequential, such as a series of images of a horse galloping. Alternatively, the coded images can be related, such as a related series of words or graphics. Still further, the plurality of coded images could be unrelated.

The present inventor advanced the art of coded animation with, among other things, the teachings found in his U.S. Pat. No. 5,901,484 for a Manually-Operated Moveable Display Device, U.S. Pat. No. 6,286,873 for a Visual Display Device with Continuous Animation, U.S. Pat. No. 7,151,541 for a Moveable Animated Display Device, and U.S. Pat. No. 7,331,132 for a Rotatable Animation Device. The disclosure of each patent is incorporated herein by reference.

The '484 patent presented solutions to many deficiencies of the prior art by providing inner and outer sleeves having coded images and shutter elements respectively printed thereon whereby a contact pressure is exhibited that provides close contact between the sleeves and, as a result, crisp, sharply animating images. With the '873 patent, the inventor disclosed a transparent panel with coded images and shutter elements on opposite sides thereof to achieve continuous animation without relatively moving parts. In the '132 patent, rotatable animation is created through a flexible substrate member having a bowed central portion for ensuring effective contact with a second substrate member. Even further, the '541 patent represented a marked advance in the art by ensuring effective contact between coded images and shutter elements through a biasing formation in a pressure plate of resiliently deflectable material.

In a clear demonstration of the advances that these inventions represented in a relatively crowded art, embodiments of the animation devices have achieved worldwide commercial success. The inventions have been embodied in self-animating toys, cards, and best-selling children's books. Indeed, books taking advantage of the invention of U.S. Pat. No. 7,151,541 and other contributions of the present inventor have millions of volumes in print in over sixteen languages as of the writing of this document. The popularity of the self-animating books, cards, and other structures is advantageous in that, among other things, observers are able to enjoy a uniquely effective and entertaining form of artwork.

The prior art has also disclosed illuminated coded image animation devices wherein first and second tubular sleeves are retained in a generally concentric manner with coded images on the first sleeve and shutter elements disposed on the second sleeve. Relative rotation of the first sleeve relative to the second sleeve will thus tend to produce animation. The devices are typically illuminated from within, such as by an electric bulb designed to simulate a candle's flame or by an actual candle.

Disadvantageously, however, it has apparently been found difficult under such prior art constructions to achieve crisp and clear animation of the coded images. The present inventor has realized that the deficiency has resulted largely from the lack of close contact between the first and second sleeves and the coded images and shutter elements retained thereon. For example, motorized prior art devices are disclosed by the prior art where an inner cylinder is spaced from the outer cylinder, apparently to prevent hindering of rotation of one cylinder relative to the other. Indeed, the illuminated cylindrical coded image devices of the prior art tend to teach away from having direct contact between the inner and outer cylinders since rotation is often induced by the heat from a bulb or candle flame and any frictional resistance will entirely prevent rotation. However, the inventor has appreciated that the same spacing that permits free rotation is what prevents crisp and clear animation; where the coded images are not in close proximity or contact with the shutter elements, blurring and other deleterious display characteristics result as is evidenced by the devices of the prior art.

Based on this knowledge, the inventor has realized that crisp and clear animation could be achieved in relation to such animation devices by achieving close engagement or contact between first and second sleeves and, as a result, realizing crisp and clear animation, while permitting smooth and efficient rotation of the first sleeve relative to the second sleeve.

SUMMARY OF THE INVENTION

Accordingly, the present invention was founded on the basic object of creating an illuminated animation device with inner and outer cylindrical sleeves that animates in a crisp and clear manner. A related object of the invention is to provide such an illuminated cylindrical animation device wherein close contact between first and second sleeves is realized while smooth and efficient relative rotation between the first and second sleeves is nonetheless permitted and achieved.

These and further objects and advantages of embodiments of the invention will become obvious not only to one who reviews the present specification and drawings but also to those who have an opportunity to enjoy the use of an embodiment of the animation device disclosed herein. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In one practice of the invention, the animation device for producing animation of interlaced coded images has an inner sleeve and an outer sleeve retained for concentric rotation relative to the inner sleeve. The inner and outer sleeves have proximal portions and distal portions. A plurality of interlaced coded images are retained by the inner sleeve or the outer sleeve, and a plurality of spaced shutter elements and interposed viewing elements are retained by the other of the inner sleeve and the outer sleeve. The inner and outer sleeves can be retained by a base structure with either the inner sleeve or the outer sleeve rotatable in relation to the base structure and the other of the inner sleeve and the outer sleeve fixed against rotation relative to the base structure. A light source can be disposed within the inner sleeve, and a motor can be engaged to rotate the inner or outer sleeve that is rotatable.

Embodiments of the animation device can have the sleeve that is fixed against rotation relative to the base structure fixed against rotation by a fixation member that has a proximal portion fixed to the base structure and a distal portion fixed to the distal portion of the sleeve that is fixed against rotation. By way of example, the fixation member could be a sleeve, such as a frusto-conical sleeve, that at least partially encases the inner and outer sleeves.

To contribute to the stable retention of the sleeves and the cylindrical configuration thereof, a substantially rigid annular ring can be retained by the fixation member, and the sleeve that is fixed against rotation relative to the base structure can be fixed relative to the annular ring at the distal portion of the sleeve that is fixed against rotation. Moreover, where a rotatable platform is retained by the base structure, the sleeve that is rotatable in relation to the base structure can be retained by and fixed relative to a substantially rigid annular ring retained by the rotatable platform.

The interlaced coded images or the spaced shutter elements retained by the inner sleeve can be applied to an inwardly facing surface of the inner sleeve. The spaced shutter elements or interlaced coded images retained by the outer sleeve can be applied to an outwardly facing surface of the outer sleeve.

Manifestations of the animation device can have the inner sleeve and the outer sleeve formed from rectangular, flat panels. Each flat panel can have a first end, a second end, and opposed longitudinal edges with the shutter elements parallel to the first and second ends of the panel on which they are disposed and the coded images having image slices that are parallel to the first and second ends of the panel on which they are disposed. In such constructions, the first and second ends of the flat panel that forms the inner sleeve are fixed together to form the inner sleeve, and the first and second ends of the flat panel that forms the outer sleeve are fixed together to form the outer sleeve.

While the shutter elements and the interlaced coded images could be applied in numerous different ways, it is possible for the shutter elements to be applied to the panel on which they are disposed by printing, potentially by passing the panel through a printer in longitudinal alignment with the shutter elements. In a similar manner, the coded images can be applied to the panel on which they are disposed by printing, potentially by passing the panel through a printer in longitudinal alignment with the slices forming coded images.

Animation devices according to the invention can be formed, for instance, by providing first and second rectangular, flat panels with each flat panel having a first end, a second end, opposed longitudinal edges, and registration apertures adjacent to the first and second ends thereof. Shutter elements can be applied to one of the panels parallel to the first and second ends of that panel, and coded images can be applied to the other of the panels with coded image slices parallel to the first and second ends of that panel. The registration apertures of the first end of the first panel can be aligned with the registration apertures of the second end of the first panel, and the first and second ends of the first panel can be fixed together to form the inner sleeve. Similarly, the registration apertures of the first end of the second panel can be aligned with the registration apertures of the second end of the second panel, and the first and second ends of the second panel can be fixed together to form the outer sleeve. With the sleeves so formed, the inner sleeve can be disposed inside the outer sleeve. The inner or the outer sleeve can be fixed against rotation relative to the base structure, and the other of the inner and outer sleeves can be retained for rotation relative to the base structure.

Practices of assembling the sleeves can be carried forth with a peg board with registration pegs in locations corresponding to the registration apertures in the first and second panels. In such a method, the step of aligning the registration apertures of the first end of the first panel with the registration apertures of the second end of the first panel can be carried forth by applying the first panel to the peg board with the registration pegs received through the registration apertures of the first end of the panel, rolling the panel into a sleeve, and passing the registration pegs through the registration apertures of the second end of the panel. The step of aligning the registration apertures of the first end of the second panel with the registration apertures of the second end of the second panel can then be practiced by applying the second panel to the peg board with the registration pegs received through the registration apertures of the first end of the panel, rolling the panel into a sleeve, and passing the registration pegs through the registration apertures of the second end of the panel.

One will appreciate that the foregoing discussion broadly outlines certain goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The present invention for an illuminated cylindrical animation device is subject to widely varied embodiments. However, to ensure that one skilled in the art will be able to understand and, in appropriate cases, practice the present invention, certain preferred embodiments of the broader invention revealed herein are described below and shown in the accompanying drawing figures.

Figure 1:
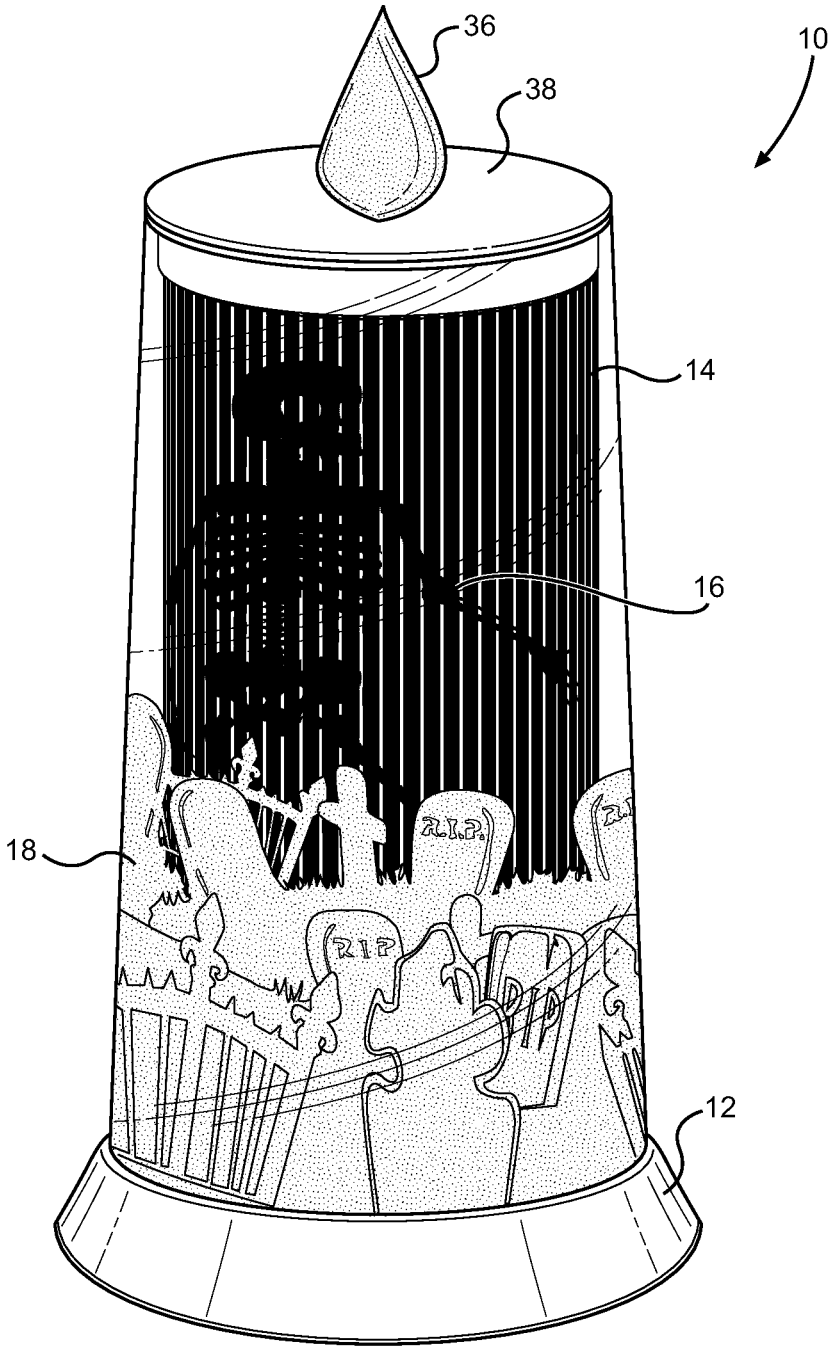
FIG. 1 is a perspective view of an illuminated cylindrical animation device pursuant to the present invention with a translucent foreground received therearound.
Figure 5A:
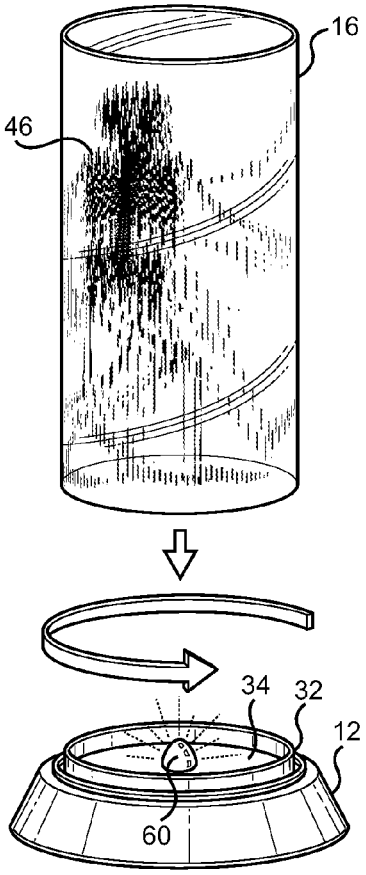
FIGS. 5A and 5B are perspective views depicting the assembly of the coded image sleeve of the animation device of FIG. 1.

Turning more particularly to the drawings, an illuminated cylindrical animation device according to the present invention is indicated generally at 10 in FIG. 1. There, the cylindrical animation device 10 takes the form of a faux, illuminated candle with a cylindrical coded image sleeve 16 retained for concentric rotation relative to a cylindrical shutter element sleeve 14. The animation device 10 is illuminated from within the sleeves 14 and 16 by a light source 60, which in this example comprises an electric bulb as best seen in FIG. 5A.

As is shown and described further herein, the coded image sleeve 16 has a base portion fixed relative to a rotatable platform 34 of a base structure 12. The platform 34 is rotatable, whether by manual operation, by motorization, or by any other rotational drive mechanism or method that might now exist or hereafter be developed. In this example of the invention, the rotational drive mechanism comprises a motor 62 that actuates reduction drive gearing 66. The drive gearing 66 can be engaged to drive the platform 34, such as by frictional engagement, a ring gear, or any other engagement. The motor 62 can be powered by a power source of any effective type, including, by way of example and not limitation, mechanical winding, direct current as by one or more batteries 64, alternating current, or any other source of power. The motor 62 can be fixed or variable in speed.

Figure 2:
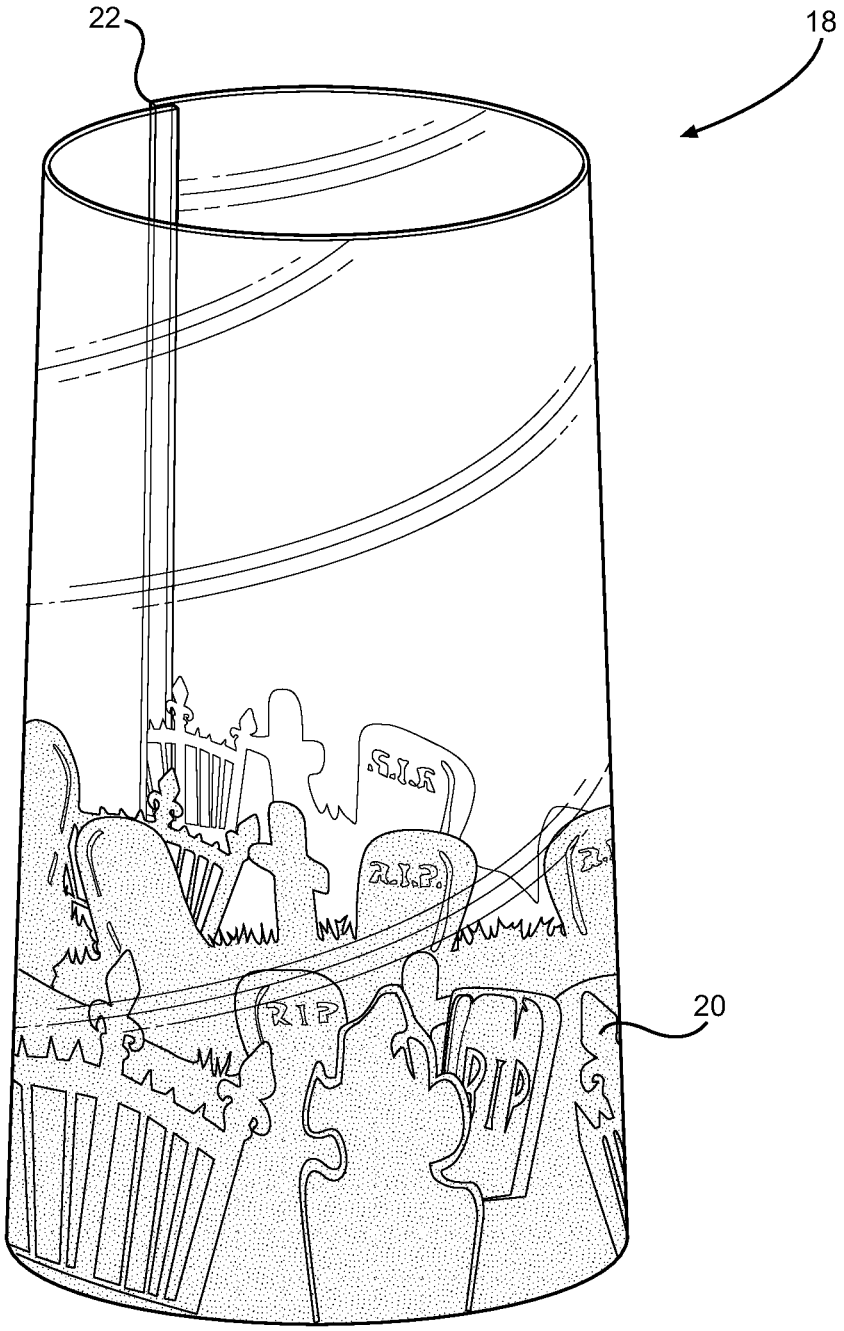
FIG. 2 is a perspective view of the translucent foreground of FIG. 1.

The shutter element sleeve 14 is supported relative to the base structure 12 but is fixed against rotation, such as by being supported and restrained at its upper or distal end by a frusto-conical sleeve 18 that has a base or proximal end fixed to a non-moving portion of the base structure 12 and an upper or distal end fixed to the upper end of the shutter element sleeve 14. The frusto-conical sleeve 18 surrounds and encases the shutter element sleeve 14 and the coded image sleeve 16. The frusto-conical sleeve 18 can be founded on a translucent, preferably transparent, substrate. Where desirable, images 20 can be retained by the frusto-conical sleeve 18 as seen in FIG. 2.

Except as the invention might be expressly limited by the claims, the sleeves 14 and 16 could be oppositely disposed. Moreover, the frusto-conical sleeve 18, which can alternatively be referred to as a fixation member, could be otherwise disposed, such as by being interior to the shutter element sleeve 14. Still further, the fixation member 18 need not be frusto-conical or a continuous sleeve or member at all. Indeed, the fixation member 18 could take the form of an arm or other structure, or multiple structures could fix the shutter element sleeve 14 against rotation relative to the base structure 12

Figure 3:
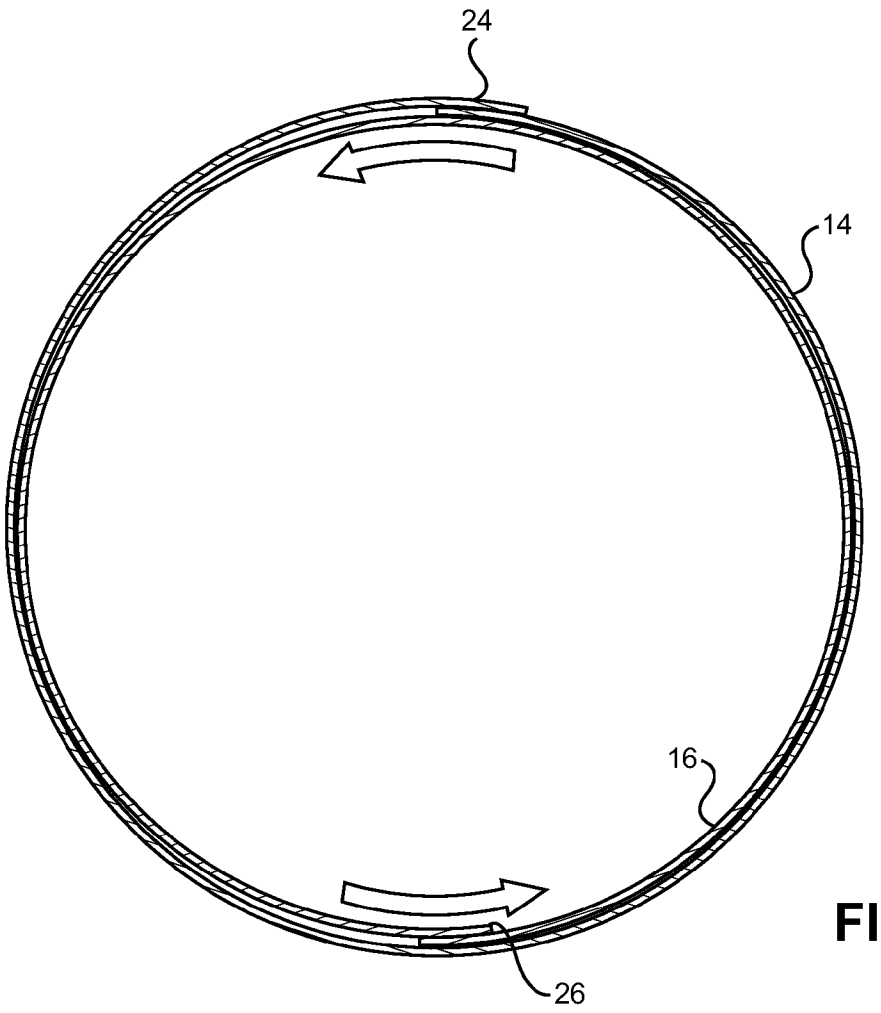
FIG. 3 is a cross-sectional view of the inner and outer sleeves of the illuminated cylindrical animation device.

Under this construction, the coded image sleeve 16 is fixed to rotate with the rotatable platform 34, and the shutter element sleeve 14 is fixed against rotation in relation to the base structure 12. Therefore, a rotation of the rotatable platform 34 will rotate the coded image sleeve 16 while the shutter element sleeve 14 is prevented from rotating even where a measurable frictional force is imparted between the sleeves 14 and 16. Accordingly, the sleeves 14 and 16 can be disposed in full, cylindrical contact as illustrated in FIG. 3 while effective rotation is nonetheless permitted. Consequently, crisp and clear animation can be achieved where the devices of the prior art have produced blurry, even indecipherable images. Again, the sleeves 14 and 16 could be oppositely disposed to similar advantage. It would also be possible to induce rotation from a fixation to the upper portion of one of sleeves 14 or 16 and to fix the bottom of the other sleeve 16 or 14 against rotation relative to a fixed portion of the base structure 12.

Figure 4A:
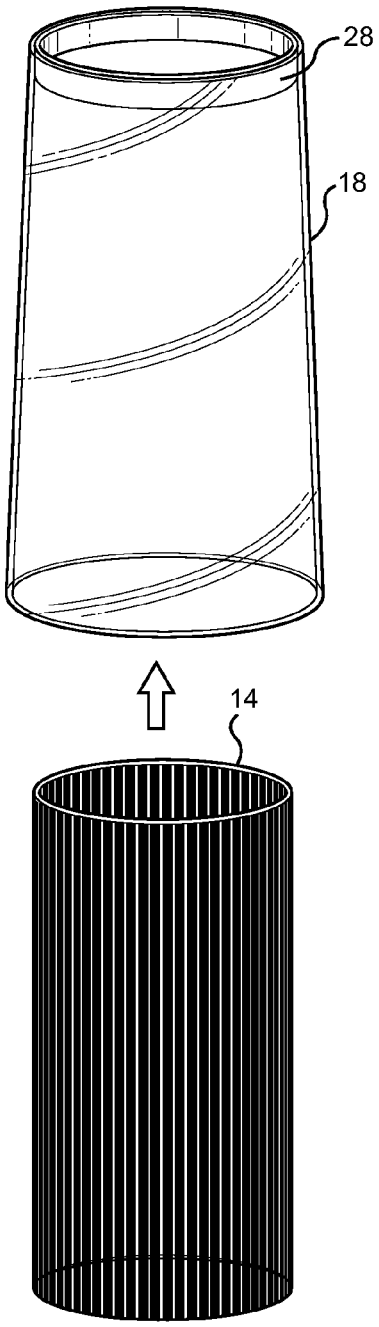
FIGS. 4A and 4B are perspective views depicting stages in the assembly of the shutter element sleeve of the animation device of FIG. 1.
Figure 4B:
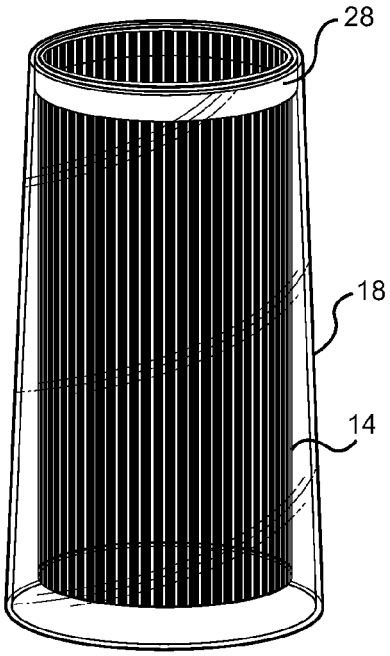

Cylindrical animation devices 10 pursuant to the invention can, for example, be constructed as is illustrated in FIGS. 4A through 6C. As seen in FIGS. 4A and 4B, a cylindrical shutter element sleeve 14 can be received within a frusto-conical sleeve 18, and the tapered portion of the frusto-conical sleeve 18 can be fixed to the upper end of the cylindrical shutter element sleeve 14 to form a unified structure as illustrated in FIG. 4B comprising the frusto-conical sleeve 18 and the shutter element sleeve 14. To facilitate the fixing of the frusto-conical sleeve 18 to the shutter element sleeve 14, or the coded image sleeve 16 where the sleeves 14 and 16 are oppositely disposed, and to maintain the upper end of the shutter element sleeve 14, and thus the upper end of the coded image sleeve 16 in a round configuration, a substantially rigid ring 28 can be mutually fixed to the upper ends of the shutter element sleeve 14 and the frusto-conical sleeve 18. For example, the ring 28 could be secured as by gluing or some other method to the inside of the upper end of the frusto-conical sleeve 18, and the upper end of the shutter element sleeve 14 could be received into the ring 28 and secured there as by gluing or some other method. With that, the inner surface of the shutter element sleeve 14 remains fully unobstructed. Of course, numerous other couplings could be carried out within the scope of the invention, including but not limited to sonic or heat welding, direct fixation, or any other method. The lower end of the frusto-conical sleeve 18 is fixed to the base structure 12 whereby the sleeve 18 and the shutter element sleeve 14 are fixed against rotation relative to the base structure 12.

It will be appreciated that the sleeve 18 could be otherwise configured, such as in the form of a cylindrical sleeve with a distal disk that projects inwardly. Moreover, it would be possible for some other restraint mechanism to be employed, such as, but not limited to, one or more upstanding members with proximal ends fixed to the base structure 12 and distal ends fixedly retaining the upper end of the shutter element sleeve 14, or the coded image sleeve 16 if the sleeves 14 and 16 are otherwise disposed.

Figure 5B:
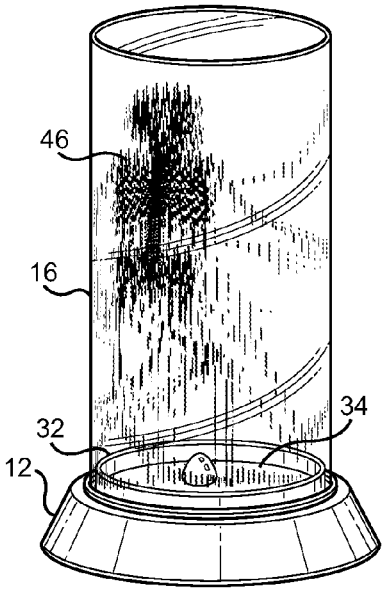

The coded image cylinder 16 can be fixed to rotate with the rotatable platform 34 of the base structure as depicted in FIGS. 5A and 5B to surround the light source 60, which could be any type of source of light, that illuminates the cylindrical animation device 10 during operation. To facilitate the coupling of the coded image cylinder 16 to the rotatable platform 34, the platform 34 can retain a substantially rigid, upstanding annular ring 32. The ring 32 can be received into the lower or proximal end of the coded image cylinder 16 and fixed thereto, as by adhesive or any other method. With this, the outer surface of the coded image sleeve 16 remains fully unobstructed, and the lower end of the coded image sleeve 16, and thus the lower end of the shutter element sleeve 14, are retained in a round configuration.

Figures 6A, 6B, 6C:
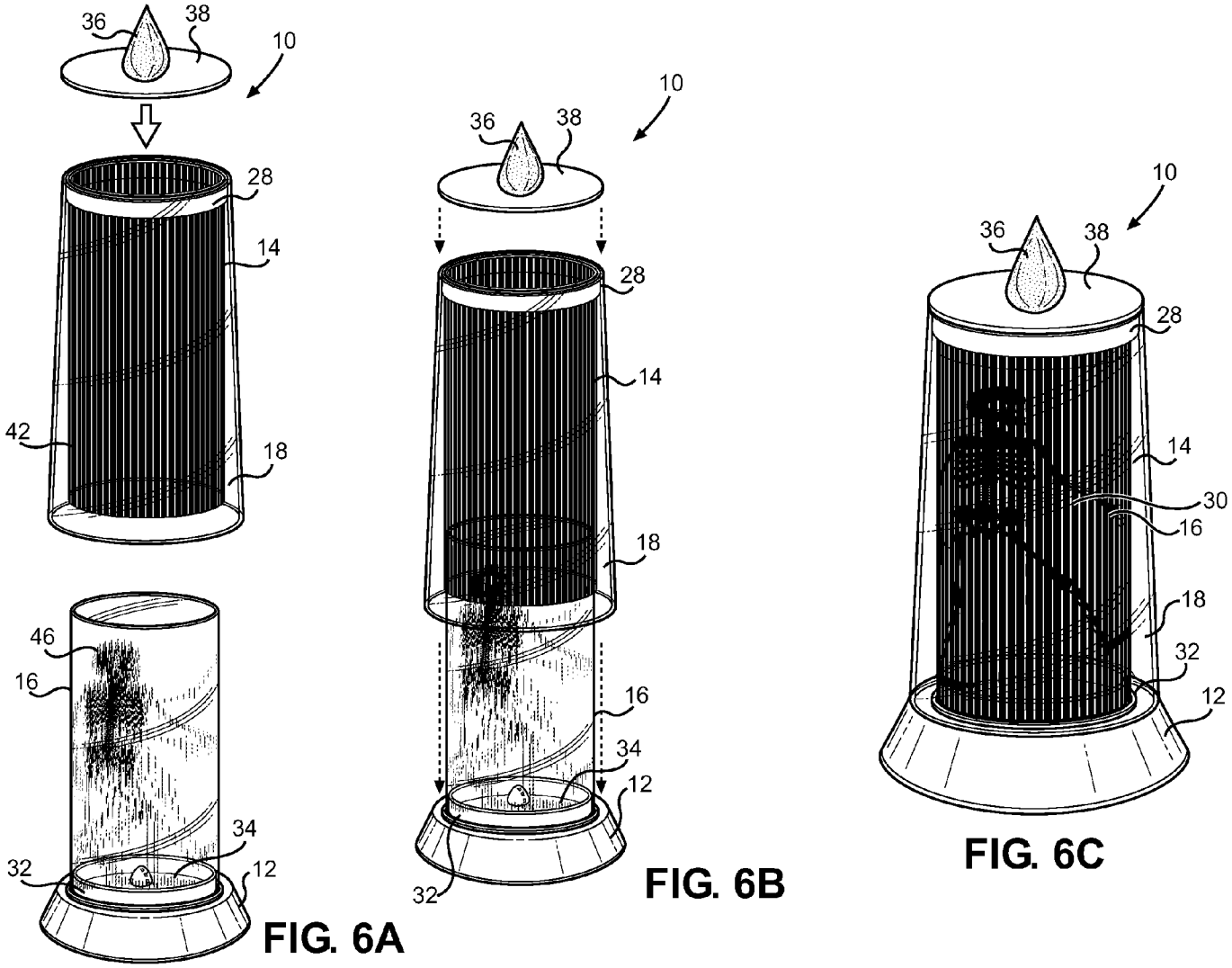
FIGS. 6A through 6C are perspective views depicting the assembly of the shutter element sleeve with the coded image sleeve.

With the shutter element sleeve 14, the coded image sleeve 16, and the frusto-conical sleeve 18 so assembled relative to the base structure 12 and one another, the shutter element sleeve 14 can be slid over the coded image sleeve 16 as shown in FIGS. 6A through 6B. More particularly, the shutter element sleeve 14 can be slid over the coded image sleeve 16 such that the cylinders of the sleeves 14 and 16 are disposed in a close, concentric relationship with the coded image sleeve 16 rotatable with the platform 34 and the shutter element sleeve 14 fixed against rotation relative to the base structure 12. The upper or distal ends of the sleeves 14 and 16 are maintained in a round configuration by the ring 28, and the lower or proximal ends of the sleeves 14 and 16 are maintained in a round configuration by the ring 32. A cap portion 38, which in this example retains the simulated flame 36 of a candle, can be fixed to upper end of the unified structure formed by the shutter element sleeve 14 and the frusto-conical sleeve 18.

Under this construction, the coded image sleeve 16 can be rotated by the platform 34 in relation to the shutter element sleeve 14 without producing a movement of the coded image sleeve 14 even with a snug relationship between the sleeves 14 and 16. Particularly when the animation device 10 is illuminated from within by the light source 60 as seen in FIG. 5A, animation of the coded images 46 will be achieved, and that animation will tend to be clear and crisp in view of the close contact that can thus be achieved between the shutter elements 42 of the shutter element sleeve 14 and the coded images 46 of the coded image sleeve 16.

The present inventor has additionally found that image resolution and relative angular velocity of the sleeves 14 and 16 is important to optimal animation. Such relative angular velocity could be achieved by rotation of the coded image sleeve 16 as in the present embodiment, by rotation of the shutter element sleeve 14, or by some combination of different rotational speeds of both the shutter element sleeve 14 and the coded image sleeve 16. To present a convincing animation, the subject presented should be of sufficient resolution to be seen clearly in some detail, and it should appear to move with a realistic cadence or speed. Accordingly, these two aspects—resolution and subject cadence—can be viewed as being inextricably linked.

The resolution of a display image is effectively determined by the size of the individual shutter elements 42. To achieve maximum resolution of a coded image 46 through the shutter elements 42, it is desirable to make the shutter elements 42 as narrow as possible: the more shutter elements 42 per inch, the higher the resolution of the subject depicted. The inventor has determined that, in consideration of industrial printing and manufacturing tolerances, individual shutter elements 42 not substantially narrower than $3/32^{nd}$ of an inch (2.38 mm) are desired. Such a width yields about 10.5 shutter elements 42 per inch (2.54 cm).

The cylindrical animation device 10 incorporates two cylindrical sleeves 14 and 16 of similar diameter—the shutter element sleeve 14 and the coded image sleeve 16, one nested snugly within the other, one stationary, and one rotating. This combination of the two sleeves 14 and 16 can be referred to as a tandem cylinder.

With shutter elements 42 spaced as above, a shutter element sleeve 14 with a 2.5 inch (6.36 cm) diameter tandem cylinder would therefore contain approximately 80 shutter elements 42. Alternatively, a larger cylindrical animation device 10 employing a tandem cylinder four times larger or 10 inches (25.4 cm) in diameter would have a shutter element sleeve 14 retaining approximately 360 shutter elements 42.

As explained herein, to achieve the effect of animation in the tandem cylinder arrangement, one cylinder 14 or 16 may rotate while the other cylinder 16 or 14 remains fixed. In the example shown in the drawings, the inner sleeve 16 retaining the coded images 46 rotates while the outer sleeve 14 retaining the shutter elements 42 remains fixed in place. The speed with which the coded image sleeve 16 turns must naturally affect the speed and cadence of the subject being depicted.

One may consider, for example, an image of a walking human figure. The natural cadence of a walking figure may be conventionally described as approximately two steps per second. From an animator's perspective, a six-phase cycle of walking may be created in which the figure completes one complete step. When this walk cycle is repeated, the figure appears to take two, three, four or more successive steps without a break in rhythm. Under the present invention, the rotation of the coded image sleeve 16 behind the stationary shutter element sleeve 14 achieves one complete walk cycle by travelling only the distance of the width of one shutter element, such as 3/32 inch (2.38 mm) under one contemplated embodiment. Thus, to achieve a realistic cadence of two steps per second in a 2.5 inch (6.36 cm) diameter tandem cylinder arrangement, the coded image sleeve 16 must rotate a distance of 3/16 inches (4.76 mm) per second such that the coded image sleeve 16 must rotate at a rate of approximately one revolution every 40 seconds. To achieve the identical subject walking cadence in a larger diameter tandem cylinder display device 10, such as one with a 10 inch (25.4 cm) diameter, with similarly sized shutter elements 42, the coded image sleeve 16 would have to rotate at half that speed: one revolution every 80 seconds.

If the shutter element size from display to display remains the same as described above, to achieve similar image resolution, it will be desirable, depending on the desired speed and cadence of the particular animated subject being depicted, that the relative speed of rotation of the coded image sleeve 16 be faster or slower. For example, in the 2.5 inch (6.36 cm) diameter tandem cylinder display device 10 discussed above, for instance, it may be desirable to depict a galloping horse completing three gallops, namely three consecutive gallop cycles, per second. In this instance, the coded image sleeve 16 would need to rotate the distance of three shutter element widths, or 9/32 inch (7.14 mm) per second with shutter elements 42 that are 3/32 inches (2.38 mm) wide, meaning it would be rotating at approximately one revolution every 30 seconds.

Alternatively, if it is desired that the subject's cadence or speed be much slower and only complete, for instance, one animation cycle every second, a tandem cylinder animation device 10 with a shutter element sleeve 14 containing 80 shutter elements would require a coded image sleeve 16 rotating at a distance of 3/32 inches (2.38 mm) per second for a rate of 80 seconds per revolution.

Figure 7B:
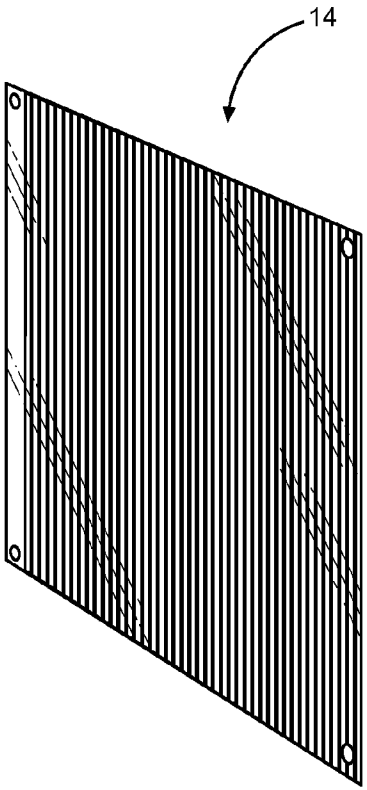
FIGS. 7A and 7B are perspective views depicting the creation of a shutter element panel to be formed into a shutter element sleeve.
Figure 7A:
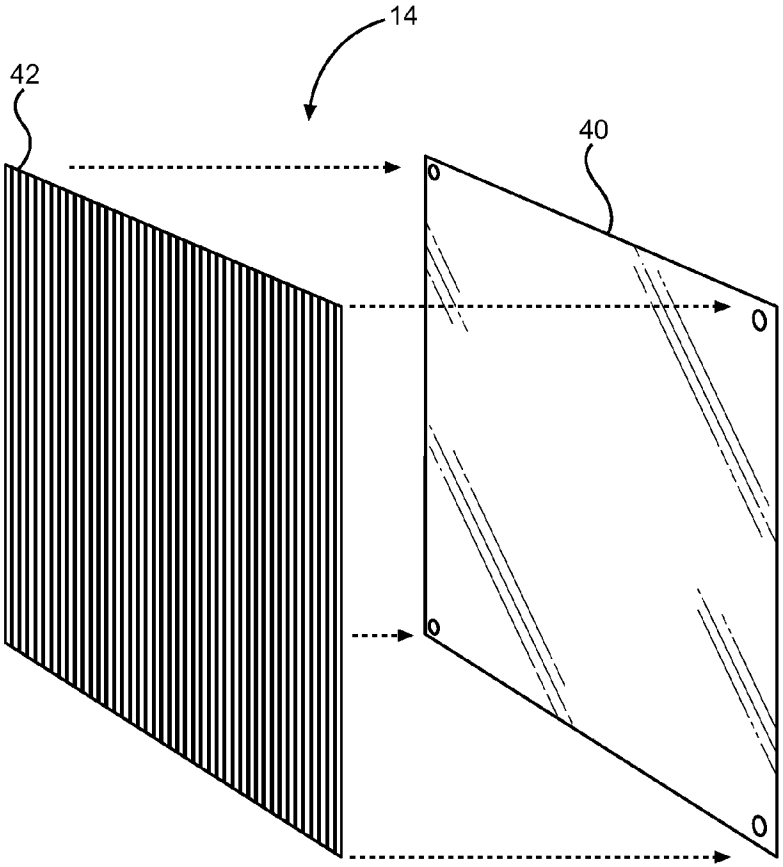
Figure 8B:
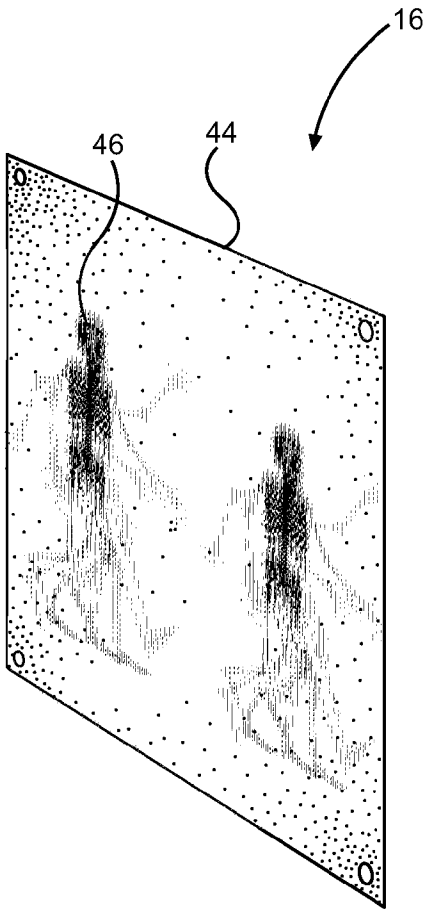
FIGS. 8A and 8B are perspective views depicting the creation of a coded image panel to be formed into a coded image sleeve.
Figure 8A:
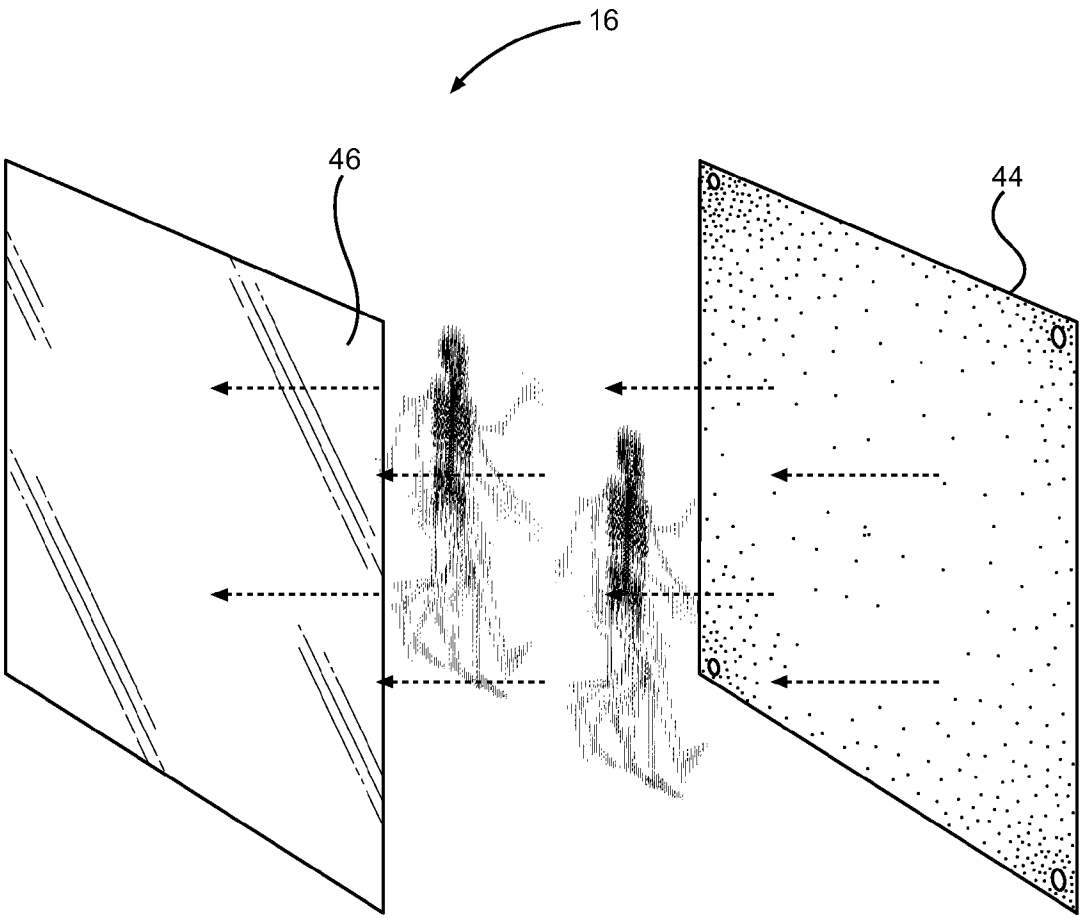
Figure 9:
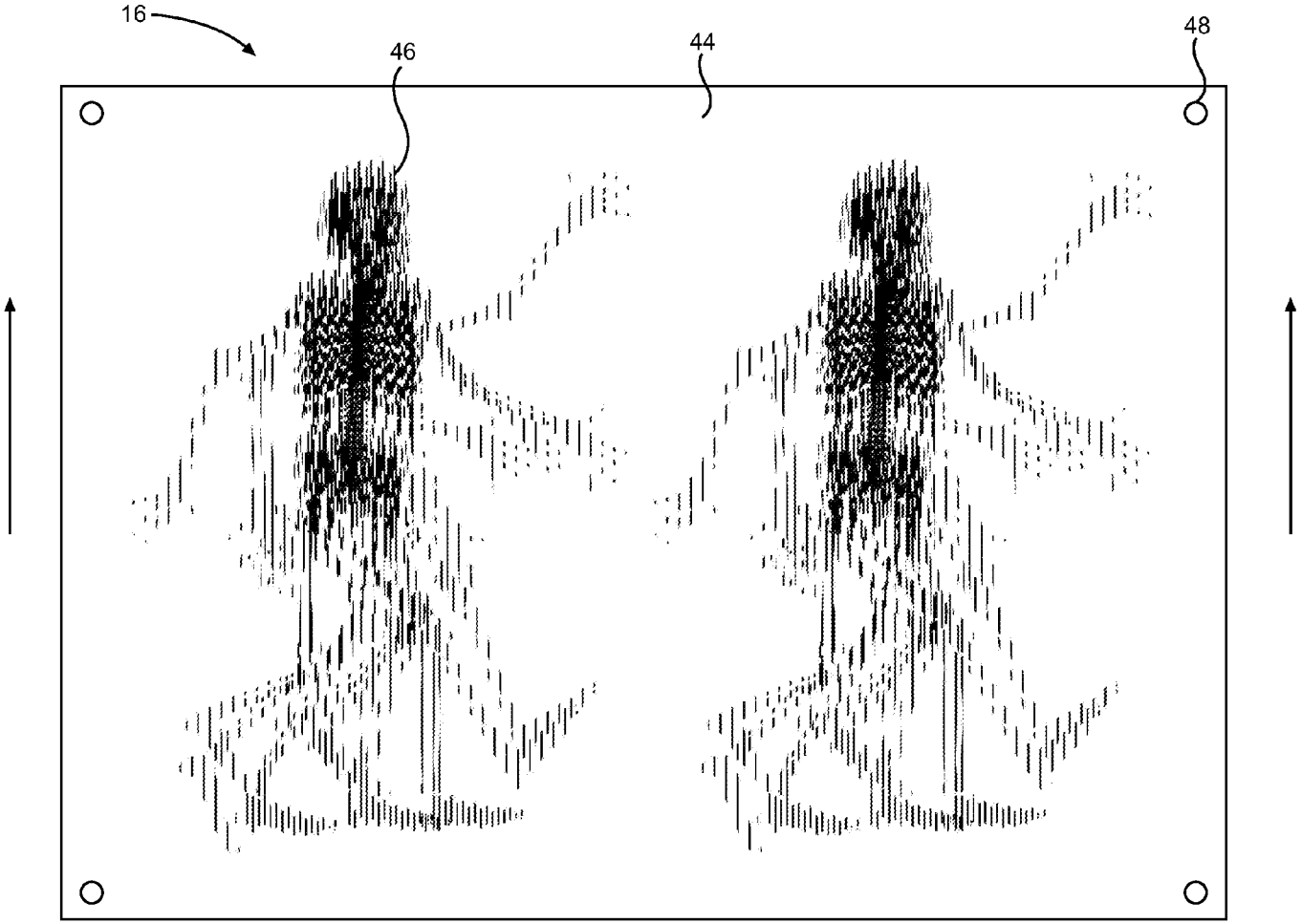
FIG. 9 is a view in front elevation of a coded image panel according to the invention.
Figure 10:
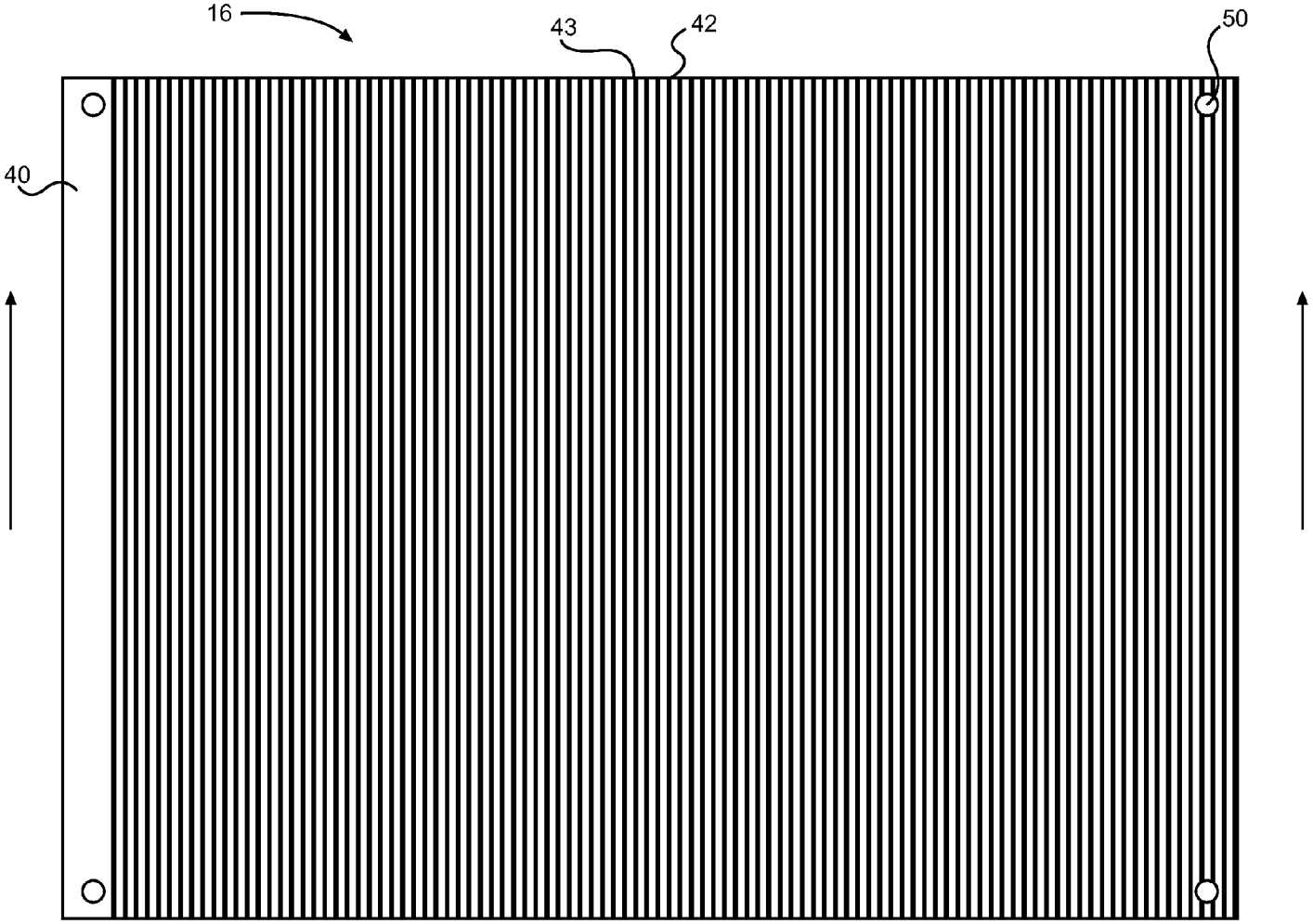
FIG. 10 is a view in front elevation of a shutter element panel according to the invention.

As one knowledgeable in the art will appreciate, the shutter element sleeve 14 and the coded image sleeve 16 could be formed from a wide variety of materials and under a variety of methods, and each such method and material should be considered to be within the scope of the invention except as it might be expressly limited by the claims. In one embodiment, the shutter element sleeve 14 can begin in panel form with ink shutter elements 42 printed or otherwise applied onto a panel 40 of clear or translucent material, such as acetate, as is illustrated in FIGS. 7A, 7B, and 10. Likewise, the coded image sleeve 16 can begin in panel form with interlaced coded images 46 printed or otherwise applied onto a diffuser layer or coded image panel 44, which again can be formed from clear acetate as in FIGS. 8A, 8B, and 9. In any case, it is believed that preferred embodiments of the animation device 10 will have at least one of the two sleeves 14 and 16 formed from a thin, flexible material to allow the flexible sleeve 14 or 16 to conform to the other sleeve 16 or 14 during rotation and thereby make the full contact desirable to clear animation. It is perhaps more preferable to have both sleeves 14 and 16 crafted from thin, flexible material, which again could comprise clear acetate.

The ink for the shutter element panel 40 can be printed such that it will be on the outside of the formed shutter element sleeve 14, and the ink for the coded image panel 44 can be printed such that it will be on the inside of the formed coded image sleeve 16. Other configurations are possible, but this may be preferable as the inks will avoid frictional contact and any potential damage as a result thereof. As indicated in FIGS. 9 and 10, where a printer is used to apply the coded images and the shutter elements, the acetate panels 40 and 44 forming the substrate for the coded images 46 and the shutter elements 42 can be processed through the printer in line with the vertical lines of the interlaced coded images 46 and the shutter elements 42.

Figure 11:
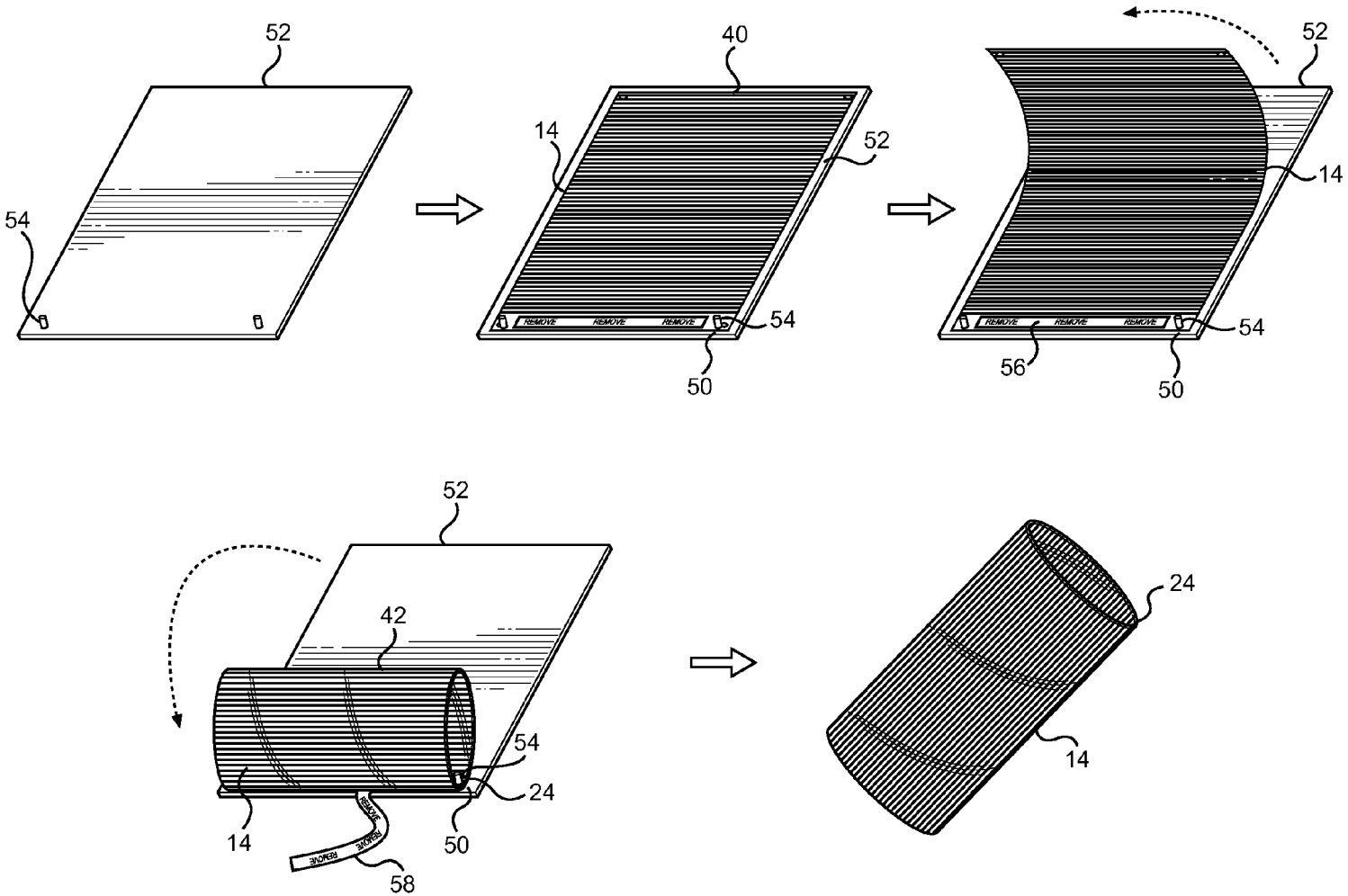
FIG. 11 is a series of perspective views depicting the formation of a shutter element panel into a shutter element sleeve.
Figure 12:
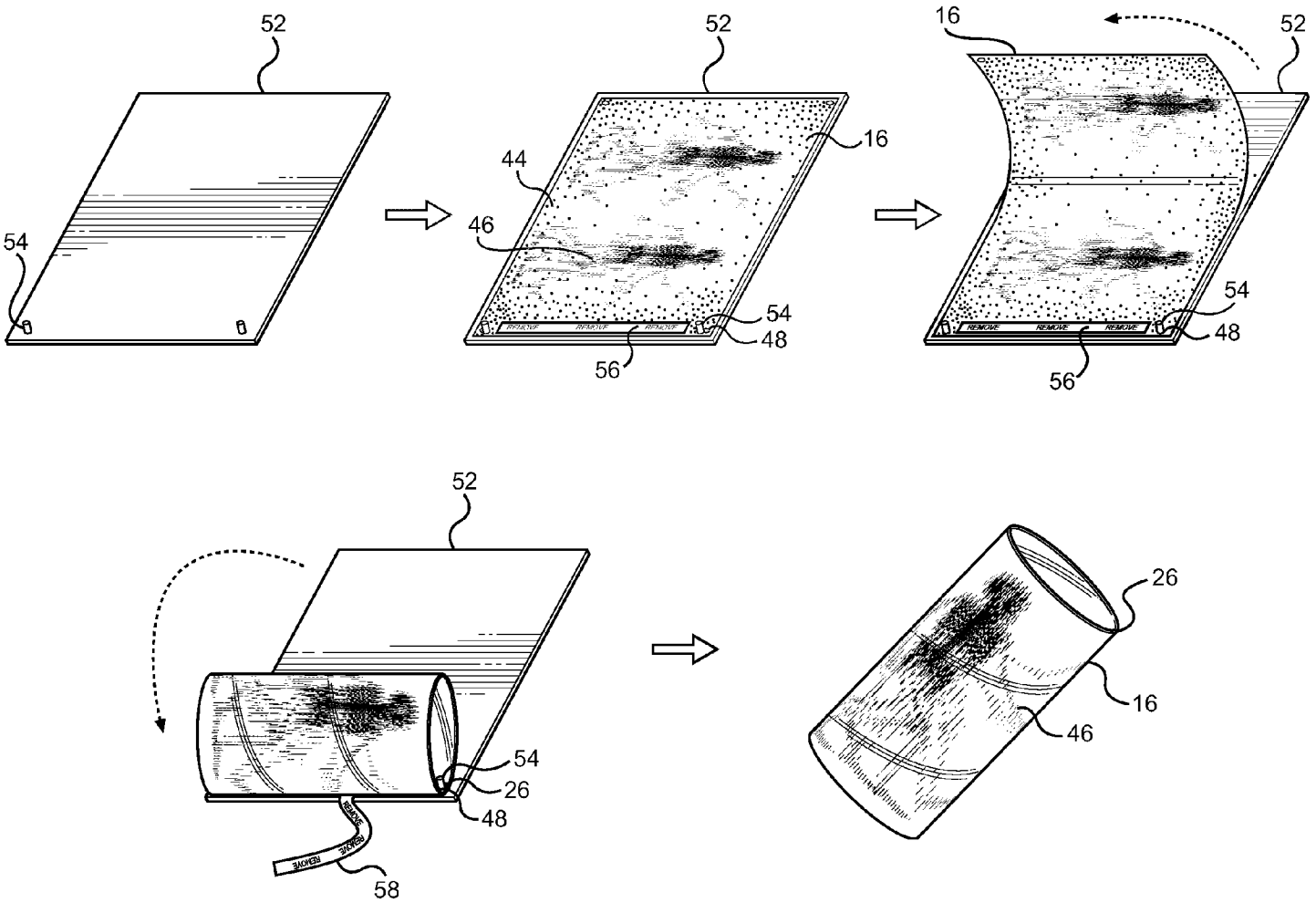
FIG. 12 is a series of perspective views depicting the formation of a coded image panel into a coded image sleeve.
Figure 13:
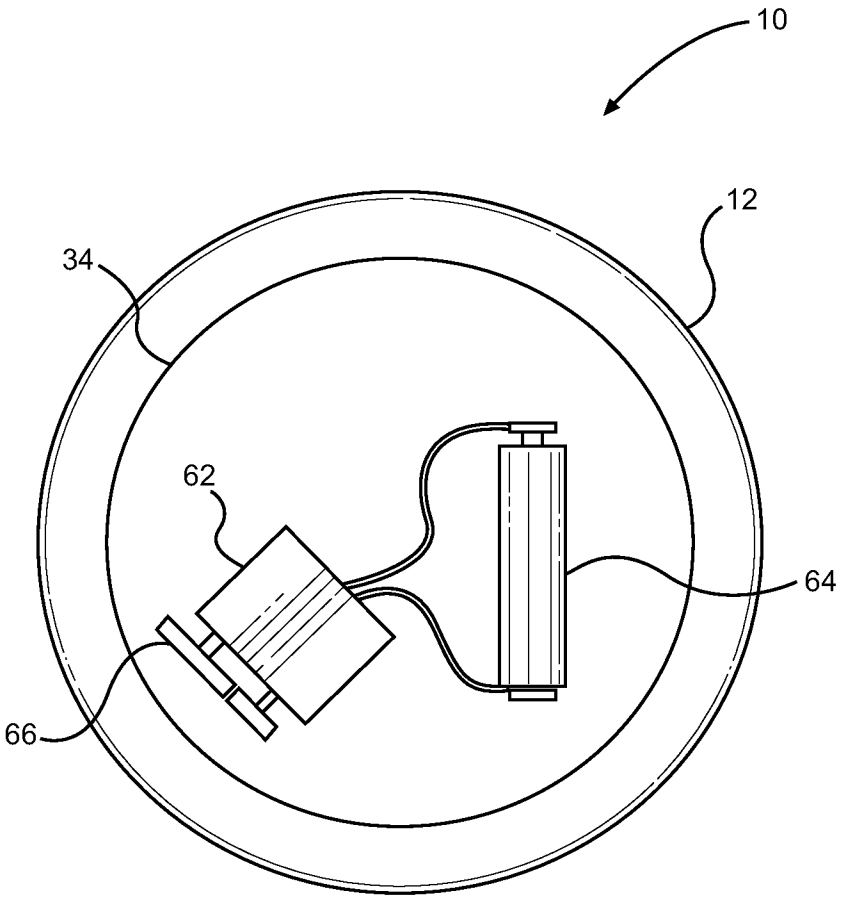
FIG. 13 is a schematic view of a drive system for an animation device as taught herein.

In presently preferred practices of the invention, the shutter element sleeve 14 and the coded image sleeve 16 can begin as flat panels as depicted in FIGS. 11 and 12. In a first step in the formation of the shutter element sleeve 14, a substantially rigid peg board 52 can be provided. Again looking to FIG. 10, the substrate panel 40 can have registration apertures 50 formed therein in predetermined locations, such as adjacent to each of the corners of the rectangular panel 50, and registration pegs 54 can project from the peg board 52 in predetermined locations corresponding to the known locations of the registration apertures 50 in the substrate panel 40. The substrate panel 40 can be disposed on the peg board 52 with the printed shutter elements 42 facing down and the registration pegs 54 received through the registration apertures 50. With that, the substrate panel 40 will be in a known orientation. Double-sided tape 56 with a removable tape liner 58 can be disposed at a first end of the substrate panel 40. The tape liner 58 can be removed, and the second end of the substrate panel 40 can then be turned over such that the registration apertures 50 in the corners of the second end of the panel 40 engage the registration pegs 54 in precise alignment with the registration apertures 50 in the first end of the panel 40. The double-sided tape 56 can then retain the substrate panel 40 in a cylindrical formation with the ends of the panel 40 coupled to form a seam 24 as seen in FIG. 3 and with the shutter elements 42 perfectly oriented longitudinally along the sleeve 14.

As shown in FIG. 12, the coded image sleeve 16 can be formed substantially identically except that the printed coded images 46 can be faced upwardly so that the images 46 will be inwardly disposed when the substrate panel 44 is formed into a cylinder. As with the shutter elements 42, the coded images 46 will thus be disposed with the vertical interlaced lines of the coded images 46 oriented longitudinally along the sleeve 16 to register properly with the shutter elements 42 of the shutter element sleeve 14. With the coded image sleeve 14 and the shutter element sleeve 16 so formed, the cylindrical animation device 10 can be assembled as described previously.

The above-described formation method has been found to be highly advantageous in producing shutter element sleeves 14 and coded image sleeves 16 not only with the shutter elements 42 and coded images 46 in perfect orientation but also in ensuring that the sleeves 14 and 16 have the consistent, predetermined circumferences necessary to proper function and clear animation. The inventor has recognized that, to make an active displayed image 30 cohesive throughout a rotation cycle, the shutter element sleeve 14 must have an exact circumference such that the last shutter elements 42 and coded images 46 at the seams 24 and 26 of the sleeves 14 and 16 as seen in FIG. 3 have identical widths to those along the bodies of the sleeves 14 and 16. Moreover, the relative circumferences of the coded image sleeve 14 and the shutter element sleeve 16 must be precise so that the two can fit together, rotate, and make fully contact over substantially their entire circumferences. Put simply, if the last shutter element 42 or viewing element interposed between shutter elements 42 as shown in FIG. 10 is too narrow or too wide, the animation will fall out of phase, and the sleeves 14 and 16 will not fit together in a rotatable engagement with close circumferential contact if either of the sleeves 14 or 16 has an incorrect circumference.

The registration pegs 54 and the registration apertures 48 and 50 in this embodiment give the sleeves 14 and 16 exact, predetermined circumferences. The apertures 50 in the coded image sleeve 14 are slightly closer together than the apertures 48 in the shutter element sleeve 16. With this, when the registration apertures 48 and 50 are caused to overlie the registration pegs 54 and the ends of the sleeves 14 and 16 are secured together as described, a desired circumferential difference is achieved, and the shutter elements 42, the viewing elements 43, and the coded images 46 are consistently spaced, even over the seams of the sleeves 14 and 16. The present embodiment further ensures the proper orientation and spacing of the shutter and viewing elements 42 and 43 and the circumference of the shutter element sleeve 14 by having the last shutter elements 42 at the ends of the shutter element sleeve 14 overlap one another such that precise location and orientation can be confirmed.

With certain details and embodiments of the present invention for a cylindrical animation device 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention.

It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

The invention claimed is:

1. An animation device for producing animation of interlaced coded images, the animation device comprising:

an inner sleeve with a proximal portion and a distal portion;

an outer sleeve concentrically retained relative to the inner sleeve wherein the outer sleeve has a proximal portion and a distal portion;

a plurality of interlaced coded images retained by the inner sleeve or the outer sleeve;

a plurality of spaced shutter elements and interposed viewing elements retained by the other of the inner sleeve and the outer sleeve;

a base structure wherein the inner and outer sleeves are retained by the base structure;

wherein the inner sleeve or the outer sleeve is rotatable in relation to the base structure and wherein the other of the inner sleeve and the outer sleeve is fixed against rotation relative to the base structure; and a fixation member with a proximal portion and a distal portion wherein the proximal portion of the fixation member is fixed to the base structure and wherein the distal portion of the fixation member is fixed to the distal portion of the inner sleeve or the outer sleeve that is fixed against rotation.

2. The animation device of claim 1 further comprising a light source disposed within the inner sleeve.

3. The animation device of claim 1 further comprising a motor engaged to rotate the inner or outer sleeve that is rotatable.

4. The animation device of claim 1 wherein the fixation member at least partially encases the inner and outer sleeves.

5. The animation device of claim 4 wherein the fixation member comprises a sleeve.

6. The animation device of claim 1 further comprising a substantially rigid annular ring retained by the fixation member wherein the sleeve that is fixed against rotation relative to the base structure is fixed relative to the annular ring at the distal portion of the sleeve that is fixed against rotation.

7. The animation device of claim 6 further comprising a rotatable platform retained by the base structure wherein the sleeve that is rotatable in relation to the base structure is retained by the rotatable platform and further comprising a substantially rigid annular ring retained by the rotatable platform wherein the proximal portion of the sleeve that is rotatable in relation to the base structure is fixed relative to the annular ring.

8. The animation device of claim 1 further comprising a rotatable platform retained by the base structure wherein the sleeve that is rotatable in relation to the base structure is retained by the rotatable platform.

9. The animation device of claim 1 wherein the shutter elements and the viewing elements are retained by the inner sleeve and the coded images are retained by the outer sleeve.

10. An animation device for producing animation of interlaced coded images, the animation device comprising:

an inner sleeve with a proximal portion and a distal portion;

an outer sleeve concentrically retained relative to the inner sleeve wherein the outer sleeve has a proximal portion and a distal portion;

a plurality of interlaced coded images retained by the inner sleeve or the outer sleeve;

a plurality of spaced shutter elements and interposed viewing elements retained by the other of the inner sleeve and the outer sleeve;

a base structure wherein the inner and outer sleeves are retained by the base structure;

wherein the inner sleeve or the outer sleeve is rotatable in relation to the base structure and wherein the other of the inner sleeve and the outer sleeve is fixed against rotation relative to the base structure; and wherein the interlaced coded images or the spaced shutter elements retained by the inner sleeve are applied to an inwardly facing surface of the inner sleeve and wherein the spaced shutter elements or interlaced coded images retained by the outer sleeve are applied to an outwardly facing surface of the outer sleeve.

11. The animation device of claim 10 further comprising a rotatable platform retained by the base structure wherein the sleeve that is rotatable in relation to the base structure is retained by the rotatable platform.

* * * * *